US005319850A

United States Patent [19]

Charbonnel et al.

[11] Patent Number: 5,319,850

[45] Date of Patent: Jun. 14, 1994

[54] METHOD OF FIXING STEMMED BLADE FOR A FLOW-STRAIGHTENING STAGE OF A GAS TURBINE ENGINE

[75] Inventors: Jean-Louis Charbonnel, Le Mee sur Seine; Gérard G. Miraucourt, Brie Comte Robert; Jacky Naudet, Bondoufle, all of France

[73] Assignee: Societe Nationale d'Etude et de Construction de Moteurs d'Aviation "S.N.E.C.M.A.", Paris, France

[21] Appl. No.: 45,224

[22] Filed: Apr. 13, 1993

Related U.S. Application Data

[63] Continuation of Ser. No. 806,269, Dec. 13, 1991, Pat. No. 5,236,304.

[30] Foreign Application Priority Data

Dec. 27, 1990 [FR] France ..... 90 16286

[51] Int. Cl.[5] ..... B23P 15/00

[52] U.S. Cl. ..... 29/889.22; 29/525.1; 29/889.21

[58] Field of Search ..... 29/889.21, 889.22, 525.1; 415/190-191, 208.1, 204.2; 416/223 A

[56] References Cited

U.S. PATENT DOCUMENTS

| | | | |
|---|---|---|---|
| 3,073,569 | 1/1963 | Wagner | 415/204 A |
| 3,325,087 | 6/1967 | Davis | 415/209.3 |
| 3,521,974 | 7/1970 | Zerlauth | 415/208.1 |
| 4,710,103 | 12/1987 | Faber et al. | 29/889.21 |
| 4,884,951 | 12/1989 | Meylan et al. | 29/889.21 |
| 5,052,891 | 10/1991 | Burkholder | 29/889.21 |
| 5,062,767 | 11/1991 | Warley et al. | 415/209.3 |
| 5,078,576 | 1/1992 | Hayton | 415/209.3 |
| 5,087,174 | 2/1992 | Shannon et al. | 29/889.21 |
| 5,118,257 | 6/1992 | Blakeley et al. | 29/889.21 |
| 5,152,669 | 10/1992 | Heinig | 29/889.21 |

*Primary Examiner*—Irene Cuda

*Attorney, Agent, or Firm*—Oblon, Spivak, McClelland, Maier & Neustadt

[57] ABSTRACT

A stemmed blade for flow-straightener blading of a gas turbine engine includes at least one shank at the head of the blade forming a stem for use in fixing the blade. The shank has a notched portion situated adjacent the head of the blade and an end portion separated from the notched portion by a zone of lower tensile strength. Fixing of the blade to the engine casing is carried out by fitting the blade in position with the shank projecting radially outwards through a hole in the casing and then crimping a bush on to the notched portion of the shank using a suitable crimping tool which exerts a compressive force on the bush while exerting a traction force on the end of the shank until the zone of lower tensile strength breaks.

1 Claim, 1 Drawing Sheet

METHOD OF FIXING STEMMED BLADE FOR A FLOW-STRAIGHTENING STAGE OF A GAS TURBINE ENGINE

This is a continuation of application Ser. No. 07/806,269, filed on Dec. 13, 1991, now U.S. Pat. No. 5,236,304.

BACKGROUND OF THE INVENTION

1. Field of the Invention

The present invention relates to blades for gas turbine engines and to the means for fixing these blades.

More precisely, the invention relates to a stemmed blade for flow-straightening blading of a gas turbine engine, the blade comprising at least one shank at its head forming a stem intended for the fixing of said blade.

2. Description of the Prior Art

In general, the blades of a flow straightener are fixed at their head to the outer casing of the gas turbine engine, and their inner ends are interconnected by internal annular members defining the inner profile of the active fluid flow path and ensuring a seal with the rotor of the engine.

It is known a practice to connect several blades rigidly together on a common sector forming part of the annular member, the blades having threaded radial shanks integral with the heads of the blades and designed to pass through corresponding holes provided in the outer casing of the engine. These shanks serve to fix the blades through cooperation with nuts. The disadvantage of this method of fixing is that it involves high production costs and, in the event of the deterioration of a blade, necessitates dismantling a whole sector of blades.

Also known are rotor blades which comprise studs at their heads intended for the fixing of an outer ring. In this regard U.S. Pat. No. 2,197,335 shows segments capping the blades and fixed to them by bushes and crushing of the studs. The application of this technique to the fixing of the blades of a flow straightener stage to the outer casing of the gas turbine engine would necessitate special tooling for crushing the studs.

SUMMARY OF THE INVENTION

The aim of the present invention is to provide a flow-straightener blade for a gas turbine engine which can be individually fixed to the casing by a quick-fix fastening and which brings about a reduction in weight of the gas turbine engine.

To this end, according to the invention there is provided a stemmed blade for flow-straightening blading of a gas turbine engine, the blade comprising at least one shank at its head forming a stem for the fixing of the blade, the shank having a notched portion adjacent the head of the blade and an end portion separated from the notched portion by a zone of lower tensile strength.

Preferably, the zone of lower tensile strength is formed by an outer annular groove.

Thanks to this structure, it is possible to fix the blade to the outer casing of a gas turbine engine by means of a deformable bush placed over the notched portion of the shank projecting radially outwards through a hole in the casing, and a suitable crimping tool by which the bush can be forced against the casing and crimped onto the notched portion while exerting traction on the end of the shank until the shank breaks in the area of the zone of lower tensile strength.

Thus, the present invention also provides a method of fixing an assembly of flow straightener blades to an outer casing of a gas turbine engine, each blade comprising at least one shank at its head forming a stem for fixing of the blade to the casing, the shank having a notched portion adjacent the head of the blade and an end portion separated from the notched portion by a zone of lower tensile strength, wherein the shank of each blade is fitted through a corresponding hole in the wall of the casing so that the shank extends radially outwards from the casing, and each blade is then fixed to the casing by placing a plastically deformable bush around the notched portion of the shank of the blade from outside the casing, and then forcing the bush against the outer wall of the casing and crushing it around the notched portion by means of a crimping tool designed to exert a compressive force on the bush while exerting traction on the end Portion of the shank until said shank breaks at the zone of lower tensile strength.

Other features and advantages of the invention will become apparent from the following description of a preferred embodiment with reference to the accompanying drawing.

DESCRIPTION OF THE PREFERRED EMBODIMENT

Figure 1:
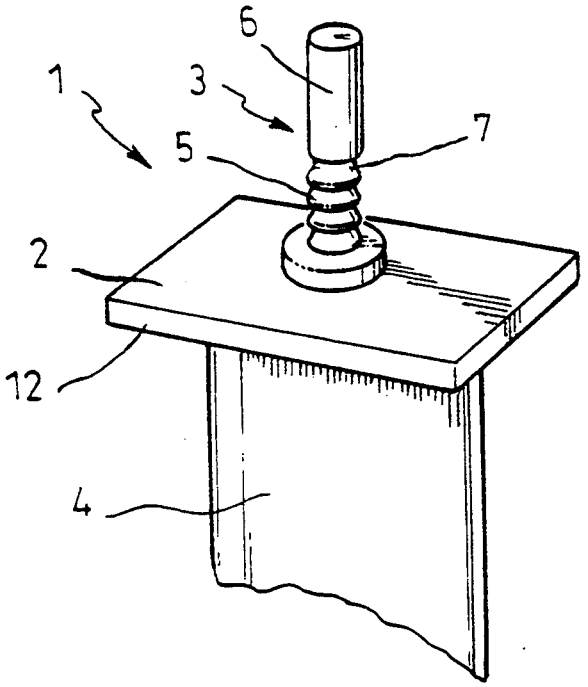
FIG. 1 shows the head of one embodiment of a flow-straightener blade in accordance with the invention.
Figure 2:
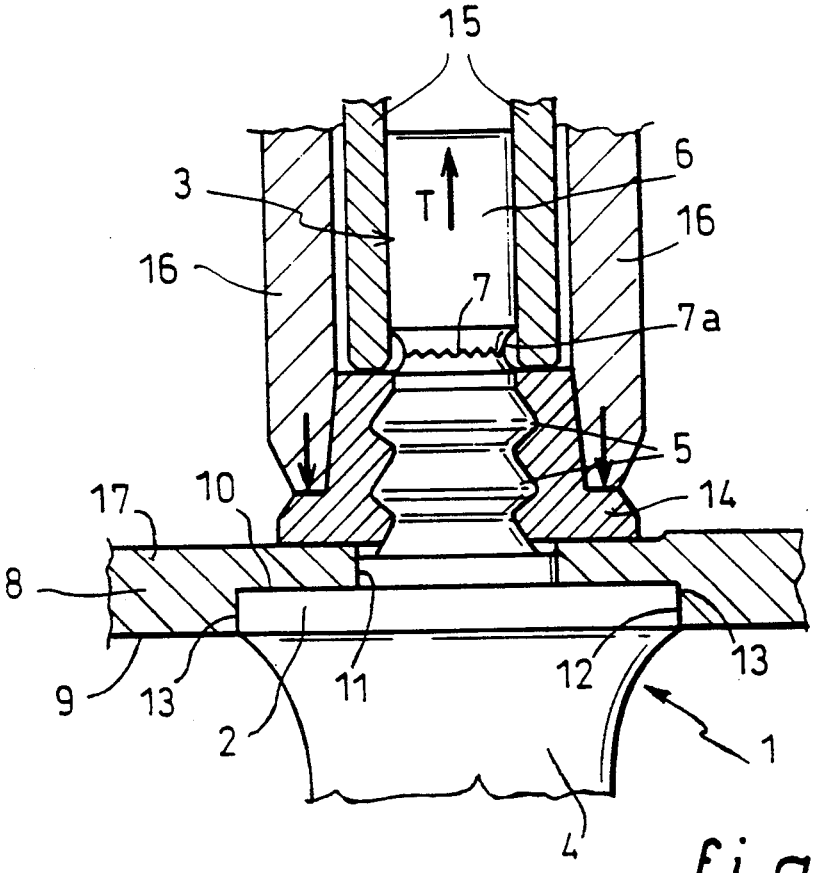
FIG. 2 is a diagrammatic partly-sectional view showing the method of fixing the blade to the outer casing of a gas turbine engine.

The blade 1 shown in the drawing is of the type with a stem at its head. It comprises a platform 2 to which is firmly attached a shank 3 which extends outwards along the longitudinal axis of the body 4 of the blade. The shank 3 has a notched portion 5 adjacent the platform 2, and a free end portion 6 separated from the notched portion 5 by a zone 7 of lower strength. Preferably, the shank 3 is made of the same material as the platform 2, and between the notched portion 5 and the end portion 6 has an annular groove 7*a* forming the zone of lower strength 7. The end portion 6 has a diameter close to that of the average diameter of the notched portion 5.

The outer casing 8 to which the blade 1 is fixed has on its inner face 9 a recess 10 which receives the platform 2 of the blade 1. A hole 11 is provided in the wall of the casing 8 at or near the center of the recess 10, this hole 11 being positioned and being of a size such that the shank passes through it and the edges 12 of the platform 2 abut against the side walls 13 of the recess 10.

The length of the notched portion 5 is such that it extends at least partly outside the casing 8 when the platform 2 is received in the recess 10.

Fixing of the blade 1 is achieved with the aid of a bush 14 which is plastically deformable under compression. The bush 14 has an inner bore of a diameter at least equal to the maximum diameter of the shank 3.

The blade 1 is fitted to the outer casing 8 in the following manner. The shank 3 is passed through the hole 11 so as to locate the platform 2 in the recess 10, and the bush 14 is placed in position around the notched portion 5 from the outside of the casing 8. An appropriate crimping tool is then used, the tool having on the one hand, jaws 15 capable of gripping the end portion 6 of the shank 3 and exerting a traction force T on the shank, and, on the other hand, an annular part 16 capable of pressing on an end face of the bush 14 and compressing the bush. The bush 14, being plastically deformable, is flattened against the outer face 17 of the casing 8 and crushed around the notched portion 5. When the traction force exerted on the shank 3 by the crimping tool becomes greater than the maximum resistance of the shank 3, the latter breaks at the position of the zone of least strength 7.

The foot of the blade is preferably embedded in an inner annular member. The blade is firmly attached to the annular member by a plastic product cast into the recess which receives the foot of the blade, but any other solution for connecting the foot of the blade to the annular member may be used.

To remove a blade, it is sufficient to cut away the plastic material joining the foot to the annular member and then to either drill or grind away the bush 14 at the head. The blade 1 is then lowered into the annular member so as to free the platform 2 from its recess 10, whereupon the blade 1 can be tilted and extracted from the annular member.

It should be noted that to allow the tilting of the blade 1 during refitting, the slot in the annular member which receives the blade 1 must be sufficiently large.

Obviously, numerous modifications and variations of the present invention are possible in light of the above teachings. It is therefore to be understood that within the scope of the appended claims, the invention may be practiced otherwise than as specifically described herein.

We claim:

1. A method of fixing a flow straightener blade to an outer casing of a gas turbine engine, said blade comprising a head and at least one shank at said head forming a stem for the fixing of said blade to the casing, said shank having a notched portion adjacent said head, and end portion, and a zone of lower tensile strength separating said end portion from said notched portion, said method comprising the steps of:

providing a hole in the wall of said outer casing for receiving said shank of said blade;

fitting said shank of said blade through said hole so that said shank extends radially outwards from said casing;

providing a plastically deformable bush;

placing said bush around the notched portion of said shank from outside said casing;

providing a crimping tool for exerting a compressive force on said bush while exerting traction on the end portion of said shank;

using said crimping tool to press said bush against said wall of said casing and simultaneously crushing said bush around said notched portion of said shank while exerting traction on said end portion until said shank breaks at said zone of lower tensile strength; and removing said crimping tool.

* * * * *